US006933140B1

(12) United States Patent
Dyson et al.

(10) Patent No.: US 6,933,140 B1
(45) Date of Patent: Aug. 23, 2005

(54) ENZYMES USEFUL FOR CHANGING THE PROPERTIES OF POLYESTER

(75) Inventors: Wade Dyson, Mocksville, NC (US); James T. Kellis, Jr., Portola Valley, CA (US); Ayrookaran J. Poulose, Belmont, CA (US); Mee-Young Yoon, Palo Alto, CA (US)

(73) Assignee: Genencor International, Inc., Palo Alto, CA (US)

( * ) Notice: Subject to any disclaimer, the term of this patent is extended or adjusted under 35 U.S.C. 154(b) by 0 days.

(21) Appl. No.: 09/435,461

(22) Filed: Nov. 5, 1999

(51) Int. Cl.[7] ..... C12N 9/00
(52) U.S. Cl. ..... 435/183
(58) Field of Search ..... 435/183, 198, 435/196, 253.3, 263, 262; 424/93.47, 94.6

(56) References Cited

U.S. PATENT DOCUMENTS

| | | | | |
|---|---|---|---|---|
| 3,018,272 | A | 1/1962 | Griffing et al. | |
| 3,057,827 | A | 10/1962 | Griffing et al. | |
| 3,381,058 | A | 4/1968 | Caldwell et al. | |
| 3,950,277 | A | 4/1976 | Stewart et al. | 510/541 |
| 4,876,024 | A | 10/1989 | Enomoto et al. | 510/174.12 |
| 5,512,203 | A | 4/1996 | Kolattukudy et al. | |
| 5,578,489 | A | 11/1996 | Petersen | 435/263 |
| 5,733,750 | A | 3/1998 | Lund et al. | 435/72 |

FOREIGN PATENT DOCUMENTS

| | | | |
|---|---|---|---|
| EP | 214761 | | 3/1987 |
| EP | 476915 | | 3/1992 |
| GB | 2307695 | * | 6/1997 |
| JP | 52082773 | | 7/1977 |
| JP | 52082774 | | 7/1977 |
| JP | 05344897 | | 12/1993 |
| WO | WO 90/09446 | | 8/1990 |
| WO | WO 97/27237 | | 7/1997 |
| WO | WO 97/33001 | | 9/1997 |
| WO | WO 97/43014 | | 11/1997 |
| WO | WO 99/01604 | | 1/1999 |
| WO | WO 00/34450 | | 6/2000 |

OTHER PUBLICATIONS

Cimecioglu et al., "Properties of Oligomers Present in Poly(ethylene Terephthalate)," *J. of Applied Polymer Science*, V. 32, 4719–4733 (1986).

"CMC: Calculation of Small Color Differences for Acceptability,"*AATCC Technical Manual*, vol. 66, pp. 321–326 (1991).

Derminot et al., "Oligomers of Polyester," *Bull. Sci. Inst. Text. Fr.*, V. 5, N. 19, pp. 215–229, (Aug. 1976).English Translation.

Duff et al., "Practical Considerations," *Gile's Laboratory cource in dyeing*, 4th Ed., pp. 7–14.

"Innovative weight reduction technique," *International Dyer*, pp. 20–24 (1999).

Hansen et al., "Polyester," *Encyclopedia of Chemical Technology*, 4th Ed., vol. 10, pp. 662–685 (1993).

"Proteolytic Enzymes: Serine and Cysteine Peptidases," *Methods in Enzymology*, Academic Press, V. 244, pp. 193–223.

McIntyre, "Polyester Fibers,"*Handbook of Fiber Science & Technology*, vol. 4, pp. 1–71 (1985).

"Means of Analyzing Oligomers in Polyester Textiles and Practical Applications," *Industrie Textile*, No. 1083, pp. 677–681 (Nov. 1978) ITT Translation No. 1769C17P).

Sato, "Deterioration of Polyurethane Filaments with Fungal Enzymes, *Aspergillus niger FERM J–1* And *Cladosporium cladosporioides FERM J–8," Sen–I Gakkaishi*, vol. 37, No. 7, pp. 80–90 (1981).

Taylor, Bruce, "Polyester into the Next Millennium," *Textile Outlook International*, Jul. 1999, pp. 129–147.

Teli et al., "Effect Of Fabric Geometry On Alkaline Hydrolysis Of Polyester: Part 1," *American Dyestuff Reporter*, pp. 28–33 (1992).

Vigo, Tyrone L., "Fabric with Improved Aesthetic and Functional Properties," *Textile Processing and Properties—Preparation, Dyeing, Finishing and Performance*, 1st Ed., (1994).

Webb, "Recommendations of the Nomenclature Committee of the International Union of Biochemistry and Molecular Biology on the Nomenclature and Classification of Enzyme;" *Enzyme Nomenclature*, pp. 306–315, 1992.

Wick et al., "Cyclic Oligomers in Polyesters Made From Diols and Aromatic Dicarboxylic Acids," *Angewandte Makromolekulare Chemie*, V. 112, N. 1771, pp. 59–94 (1983) English Translation.

Yang et al., "Ethylene Glycol and Glycerin as the Solvent for Alkaline Treatment of Poly(ethylene Terephthalate) Fabrics," *Textile Research Journal*, vol. 67, pp. 760–766 (1997).

Zahn et al., "The Impact of Natural Fiber Science on Manmade Fiber Technology," *Textile Research Journal*, vol. 43, pp. 601–606 (1973).

* cited by examiner

*Primary Examiner*—Michael Meller
(74) *Attorney, Agent, or Firm*—Genencor International, Inc.

(57) ABSTRACT

A polyesterase enzyme which produces a positive result in an UV and/or MB assay is used to treat polyester to modify polyester properties such as pilling, pilling prevention, weight, feel, appearance and luster.

8 Claims, 9 Drawing Sheets

(1000X)

| | Control | Polyesterase |
|---|---|---|
| Methylene Blue | 4.51 | 16.85 |
| C.I. Basic Orange 42 | 9.11 | 26.50 |

ENZYMES USEFUL FOR CHANGING THE PROPERTIES OF POLYESTER

BACKGROUND OF THE INVENTION

A. Field of the Invention

The present invention relates to the field of the modification of synthetic polyester used in the production of fibers, yams, fabrics, films, resins and other objects used for the production of plastics, fabrics, textiles, rugs and other consumer items. More specifically, the present invention relates to a new class of enzymes which have the ability to modify the surface of polyester resins and fibers and articles produced therewith.

B. State of the Art

Polyesters are manufactured synthetic compositions comprising any long chain synthetic polymer composed of at least 85% by weight of an ester of a substituted aromatic carboxylic acid, including but not restricted to substituted terephthalate units and parasubstituted hydroxybenzoate units. The polyester may take the form of a fiber, yarn, fabric, film, resin or powder. Many chemical derivatives have been developed, for example, polyethylene terephthalate (PET), polytrimethylene terephthalate (PTT), polybutylene terephthalate (PBT) and polyethylene naphthalate (PEN). However, PET is the most common linear polymer produced and accounts for a majority of the polyester applied in industry today.

Thermoplastic polyester can be selectively engineered in any of the basic processing steps of polymerization and fiber formation. This flexibility and range of properties allows for a wide range of products to be made from polyester for markets such as the apparel, home furnishing, upholstery, film, rigid and flexible container, non-woven fabric, tire and carpet industries. As a result, polyester has become the dominant reinforcement fiber in the United States.

Over the past 30 years cotton has continued slow, steady growth of volume consumed and wool has been virtually flat. Polyester, however, has begun to take on increased significance. Moreover, polyester has reached a higher level of consumer acceptance due to recognition of its strength and the increasing quality and variety of fabrics that can be made using such fibers. Other polyester markets such as fiber-fill and non-woven articles continue to grow.

In the textile industry, polyester has certain key advantages including high strength, soft hand, stretch resistance, stain resistance, machine washability, wrinkle resistance and abrasion resistance. However, polyester is not so optimal in terms of its hydrophobicity, pilling, static, dyeability, inactive surface as a medium for adhering, i.e., softening or wettability enhancing compounds, lack of breathability and undesirable high shine or luster appearance. Moreover, in the 1960's and 1970's, polyester textiles suffered from poor consumer perception and was synonymous with the phrase "cheaply made" and derided for the horrendous colors with which polyester was associated This latter problem is due in large part to the unavailability of a large selection of dyes which are compatible with polyester. To combat this perception, the industry has made strong efforts to improve the characteristics of polyester.

One attribute that the industry has sought to achieve with treatments of polyester is to provide depilling and pilling prevention to polyester garments. The industry has also sought to improve the hand and feel of polyester, for example, by decreasing the weight of polyester fabrics.

Another problem area involves the characteristic that polyester is very resistant to uptake of polar or charged compositions, i.e., fabric softeners, finishes and dyes. Another problem with polyester relates to the difficulty of removing oily and/or hydrophobic stains. These stains often adhere strongly to the fabric or fiber and cause a permanent stain.

GB 2296011 A discloses enzymes naturally produced by a fungus of the species Fusarium solanii var. minus T.92.637/1, including a cutinase of isoelectric point 7.2 and mol. wt. 22 kDa. which are useful in detergent compositions for removing fatty acid-based dirt and stains.

U.S. Pat. No. 5,512,203 discloses cleaning compositions comprising a cutinase enzyme and a cutinase compatible surfactant. The microbial cutinase is from *Pseudomonas mendocina* and is used in an improved method for enzymatically cleaning a material having a cutin or cutin-like stain.

PCT Publication No. WO 97/43014 (Bayer AG) describes the enzymatic degradation of polyesteramide by treatment with an aqueous solution comprising an esterase, lipase or protease.

JP 5344897 A (Amano Pharmaceutical KK) describes a commercial lipase composition which is dissolved in solution with an aliphatic polyester with the result that the fiber texture is improved without losing strength. Polymers of aliphatic polyethylene are also disclosed which can be degraded by lipase from *Pseudomonas* spp.

PCT Publication No. 97/33001 (Genencor International, Inc.) discloses a method for improving the wettability and absorbency of a polyester fabric by treating with a lipase.

PCT Publication No. WO 99/01604 (Novo Nordisk) describes a method for depilling a polyester fiber or fabric and for color clarification in detergents of such fabrics by reacting with an enzyme which has hydrolytic activity on either ethyleneglycol dibenzyl ester (BEB) and/or terephthalic acid diethyl ester (ETE) subunit components.

As can be seen from the above, many advances have been made in the treatment of polyester to improve its properties. In addition, there has been some work in the area of using enzymes to achieve such results. However, this work has focused on the ability of enzymes to degrade mono- and di-ester subunits. Applicants have surprisingly discovered that a great number of enzymes which have mono- and/or di-ester hydrolysis activity do not have polyester modification properties. In contrast, Applicants discovered that a true polyesterase enzyme which has the ability to modify polyester cannot be selected merely on their ability to hydrolyze mono- and/or di-esters and must be selected using different criteria.

Thus, despite the considerable work done in the field, the industry remains in need of additional methods of producing modified polyesters with improved characteristics. For example, with respect to textiles, such improvement may relate to pilling prevention, de-pilling during manufacture, increase in desirable hand and feel and appearance, improved static resistance, increased ability to uptake hydrophilic substances, improved more natural luster and improved oily stain resistance.

SUMMARY OF THE INVENTION

It is an object of the present invention to provide for an enzyme composition which has excellent ability to modify polyester fiber and resin properties.

It is a further object of the present invention to provide for a method of enzymatically modifying the properties of an article comprising polyester fiber or resin.

It is a further object of the invention to provide for a method of treating the surface of a polyester fiber article such that the article has modified characteristics with respect to pilling prevention and depilling characteristics.

It is a further object of the invention to provide for a method of producing polyesters having unique functionalities such as having less static cling and a more natural looking appearance, e.g., being less shiny or having a more natural "luster".

It is yet a further object of the invention to provide for a polyester fiber or resin composition that, upon being woven into a textile article, has modified weight, hand and/or feel.

It is yet a further object of the invention to provide for methods of achieving such effects on unsoiled fabrics and/or during manufacture.

According to the present invention, a method is provided for treating a clean, unsoiled polyester comprising contacting said polyester textile with an enzyme solution having polyesterase activity for a time and under conditions such that the properties of the polyester are modified. Preferably, the polyester is a fiber, yam, fabric or finished textile product comprising such fiber, yarn or fabric. Further preferably, the properties that are modified comprise those such as improved hand, feel and/or weight of a textile made from such fiber, yam or article. Preferably, the textile properties of the fiber, yarn or fabric are modified.

In another embodiment of the invention, a method is provided for treating a polyester fiber, yarn or fabric, prior to its incorporation into a textile product or the application of a textile finish with an enzyme having polyesterase activity for a time and under conditions such that the properties of the polyester are modified. Accordingly, in the embodiment wherein textile components are treated separately, the treated polyester components (i.e., fibers, yams, fabrics), may be incorporated into a textile product through standard methods for producing polyester textiles, thus conferring the modifications to the finished textile product. Preferably, the textile properties of the fiber, yam or fabric are modified.

In yet another method embodiment of the invention, a method is provided for treating a polyester resin or film with an enzyme having polyesterase activity for a time and under conditions such that the properties of the polyester are modified. The treated polyester may be a finished resin or film product or may be incorporated into a product through, for example, mechanical construction, thus conferring the modifications to the finished textile product.

In yet another method embodiment of the invention, a polyester waste product is treated with the polyesterase enzyme of the invention to degrade the polyester waste product to easily disposed of or recycled compounds. This embodiment is particularly useful in the degradation of polyester based plastics which are becoming increasingly problematic in waste disposal and dumping. An alternative of this embodiment is that the present invention may be used to increase the amount of microbially digestible material in a waste product so as to facilitate complete degradation or composting of such waste.

In yet another method embodiment of the invention, a polyester is produced from monomer units by reversing the equilibrium of the reaction using the polyesterase.

In a composition embodiment of the invention, a polyester article is provided according to the method of the invention. Preferably, the polyester article has improved weight, hand, feel, depilling or pilling prevention properties.

In a further embodiment of the invention, a method is provided for the polymerization of polyester fibers using an enzymatic catalyst.

In yet a further embodiment of the invention, a method is provided for removing a sizing material from a textile which sizing material comprises a polyester composition.

In a method embodiment of the invention, an assay is provided for the isolation and/or determination of a polyesterase enzyme. In a composition embodiment of the invention, a kit is provided for carrying out the assay.

DETAILED DESCRIPTION OF THE INVENTION

Figure 1:
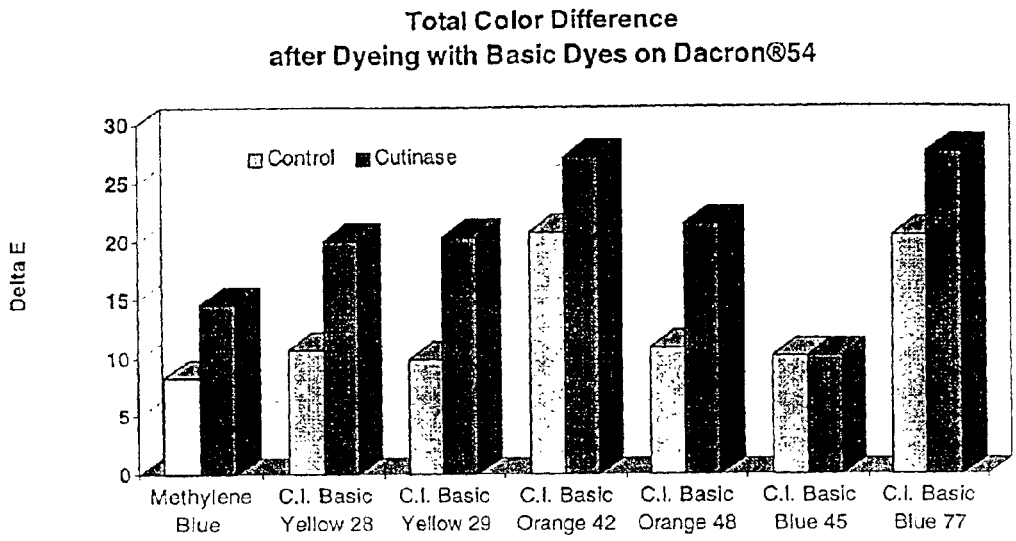
FIG. 1 illustrates the effect of polyesterase treatments on the dyeability of Dacron 54.

According to the present invention, a method is provided for treating a clean, unsoiled polyester comprising contacting said polyester textile with an enzyme solution having polyesterase activity for a time and under conditions such that the properties of the polyester are modified. Preferably, the polyester is a fiber, yarn, fabric or finished textile product comprising such fiber, yarn or fabric. Further preferably, the properties that are modified comprise those such as improved hand, feel and/or weight of a textile made from such fiber, yarn or article. The purpose of this embodiment of the present invention is not to provide for a method of laundering stains from polyester fabrics, but instead, to provide for a mechanism to modify the textile characteristics of a polyester comprising textile. Thus, in this embodiment of the invention, it is often advantageous to apply the polyesterase to textile products which are unsoiled, i.e., do not comprise stains which are typically subjected to commercial laundry detergents.

In another embodiment of the invention, a method is provided for treating a polyester fiber, yarn or fabric, prior to its incorporation into a textile product or the application of a textile finish with an enzyme having polyesterase activity for a time and under conditions such that the properties of the polyester are modified. Accordingly, in the embodiment wherein textile components are treated separately, the treated polyester components (i.e., fibers, yarns, fabrics), may be incorporated into a textile product through standard methods for producing polyester textiles, e.g., processes such as weaving, sewing and cutting and stitching, thus conferring the modifications to the finished textile product.

In yet another method embodiment of the invention, a method is provided for treating a polyester resin or film with an enzyme having polyesterase activity for a time and under conditions such that the properties of the polyester are modified. The treated polyester may be a finished resin or film product or may be incorporated into a product through, for example, mechanical construction, thus conferring the modifications to the finished textile product.

In yet another method embodiment of the invention, a polyester waste product is treated with the polyesterase enzyme of the invention to degrade the polyester waste product to easily disposed of or recycled compounds. This embodiment is particularly useful in the degradation of polyester based plastics which are becoming increasingly problematic in waste disposal and dumping. An alternative of this embodiment is that the present invention may be used to increase the amount of microbially digestible material in a waste product so as to facilitate complete degradation or composting of such waste.

In the method according to the invention, the polyesterase solution as provided herein is contacted with the polyester fiber, yarn, fabric or textile which comprises such fiber, yarn or fabric under conditions suitable for the enzyme to exhibit polyester modification. The present invention is preferably directed to the use of the polyesterase in the manufacture of the textile product, and not necessarily in combination with a detergent for the purpose of removing stains which occur during wear. Thus, in this embodiment, the application of the polyesterase to the polyester article occurs prior to spinning of the fiber into a yam, prior to the incorporation of the yarn into a fabric and/or prior to the construction of the textile product which comprises the polyester. However, it is within the present invention as well, and also a preferred embodiment hereon, to treat the completed textile product with the polyesterase identified herein.

In another embodiment of the invention, the polyesterase reaction is run so that the equilibrium of the catalytic reaction is shifted towards the production of polyester from monomer subunits. Such equilibrium shifts can be accomplished by one of ordinary skill in the art using routine enzymological and chemical methods including optimization of organic solvents and supercritical fluids.

"Polyester" as used herein means a linear polymeric molecule containing in-chain ester groups and which are derived from the condensation of a diacid with a diol or from the polymerization of hydroxy acids. The present invention applies to both aliphatic and aromatic polyesters. However, particularly preferred are aromatic polyester articles which are used to produce fiber and resin and that comprise a synthetically produced long chain polymer comprising at least 85%, preferably at least 90% and most preferably at least 95%, by weight of an ester of a substituted aromatic carboxylic acid, such as substituted terephthalic acid or parasubstituted hydroxybenzoate. Other useful polyester articles include those made of bulk polymer, yams, fabrics, films, resins and powders. The principal polyesters in industrial usage include polyethylene terephthalate (PET), tetramethylene terephthalate (PTMT), polybutylene terphthalate (PBT), polytrimethylene terephthalate (PTT) and polyethylene naphthalate (PEN), polycyclohexanedimethylene terephthalate (CHDMT), poly(ethylene4-oxybenzoate) A-Tell, polyglycolide, PHBA and 2GN. Polyester as used herein may take the form of fiber, yarn, fabric, textile article, or any other composition wherein polyester fibers, yams or fabrics are employed.

"Polyesterase" means an enzyme that has significant capability to catalyze the hydrolysis and/or surface modification of PET. Specifically, Applicants have discovered that enzymes which have hydrolytic activity against PET under the conditions provided in the UV and MB assays provided in Example 1(a) and 1(b) (referred to herein as the "UV Assay" and the "MB Assay" respectively) are useful in the treatment of polyester resins, films, fibers, yams and fabrics to modify the properties thereof. Accordingly, the assays provided in Example 1(a) and 1(b) may be used to isolate polyesterase enzymes and/or determine the polyesterase activity of an enzyme.

Applicants have surprisingly found that enzymes according to the present invention represent a subclass of enzymes which have significant activity against polyester and are capable of producing improved surface modification effects. By contrast, enzymes defined by prior art assays appear to be more general and to have a greater instance of false positive results. Assays designed to measure hydrolysis of mono- and di-ester units, such as the assays measuring ETE and BEB hydrolysis described in WO 99/01604, are useful in identifying a large number of enzymes, some of which may fortuitously have useful polyesterase activity. However, these assays are based on hydrolysis of mono- and di-ester molecules. As a consequence, these results are often not predictive of the likelihood that a specific enzyme will successfully modify the surface of long chain polyesters. Example 1(d) shows that assays designed on small molecule hydrolysis will broadly include enzymes which are useful against the mono- and di-ester molecules while not predicting with accuracy whether such enzymes have activity against large repeating polymer fibers such as long chain polyesters.

Thus, the polyesterase enzymes of the present invention will produce a positive result according to one or both of the polyesterase assays described herein. The activity of the enzymes of the invention in solution will produce an absorbance of at least 10% above the control blank, preferably 50% and most preferably 100% greater than the control blank. In a most preferred embodiment, the polyesterase enzymes of the invention will produce a positive result in both assays which is at least double the increase in absorbance reading of the blank sample.

Suitable polyesterases may be isolated from animal, plant, fungal and bacterial sources. With respect to the use of polyesterases derived from plants, polyesterases may exist in the pollen of many plants. Polyesterases may also be derived a fungus, such as, *Absidia* spp.; *Acremonium* spp.; *Agaricus* spp.; *Anaeromyces* spp.; *Aspergillus* spp., including *A. auculeatus, A. awamori, A. flavus, A. foetidus, A. fumaricus, A. fumigatus, A. nidulans, A. niger, A. oryzae, A. terreus* and *A. versicolor; Aeurobasidium* spp.; *Cephalosporum* spp.; *Chaetomium* spp.; *Cladosporium* spp.; *Coprinus* spp.; *Dactyllum* spp.; *Fusarium* spp., including *F. conglomerans, F. decemcellulare, F. javanicum, F. lini, F. oxysporum, F. roseum* and *F. solani; Gliocladium* spp.; *Helminthosporum* spp., including *sativum; Humicola* spp., including *H. insolens* and H. *lanuginosa; Mucor* spp.; *Neurospora* spp., including *N. crassa* and *N. sitophila; Neocallimastix* spp.; *Orpinomyces* spp.; *Penicillium* spp; *Phanerochaete* spp.; *Phlebia* spp.; *Piromyces* spp.; *Pseudomonas* spp.; *Rhizopus* spp.; *Schizophyllum* spp.; *Trametes* spp.; *Trichoderma* spp., including *T. reesei, T. reesei* (*longibrachiatum*) and *T. viride*; and *Ulocladium* spp., including *U. consortiale; Zygorhynchus* spp. Similarly, it is envisioned that a polyesterase may be found in bacteria such as *Bacillus* spp.; *Cellulomonas* spp.; *Clostridium* spp.; *Myceliophthora* spp.; *Pseudomonas* spp., including *P. mendocina* and *P. putida; Thermomonospora* spp.; *Thermomy-*

*ces* spp., including *T. lanuginosa; Streptomyces* spp., including *S. olivochromogenes* and *S. scabies*; and in fiber degrading ruminal bacteria such as *Fibrobacter succinogenes*; and in yeast including *Candida* spp., including *C. Antarctica, C. rugosa, torresii; C. parapsllosis; C. sake; C. zeylanoides; Pichia minuta; Rhodotorula glutinis; R. mucilaginosa*; and *Sporobolomyces holsaticus.*

"Textile" means any fabric or yam or product which incorporates a fabric or yam. Examples of textiles which may be treated with the present invention include clothing, footwear, upholstery, draperies, carpets, outdoor gear, ropes and rope based products. As used in the present invention, textile includes non-woven fabrics used in, for example, the medical industry.

"Biological material" means any composition which is derived from biological origin, including, but not limited to, cells, vectors, DNA, protein, cell membranes, cellular components, RNA or any mixture comprising such materials.

"Textile properties" means the properties of a textile comprising a polyester fiber, yam or fabric that are critical to the appearance, feel or comfort of the article. As used herein, textile properties includes depilling, antipilling, improvement of hand, improvement of feel, improvement of appearance such as luster and drape, improving the wettability or absorbency, decreasing static cling, decreasing oily soil attraction and improving soil release properties or otherwise creating a unique appearance by physical modification of the polyester in a manner so as to improve the textile in manner that provides unique features to the textile.

"Treatment" means with respect to treatment with polyesterase comprises the process of applying the polyesterase to the polyester article such that the enzyme is capable of reacting with the surface of the polyester article to such an extent that the properties of the article are significantly improved. Generally, this means that the polyesterase is mixed with the polyester article in an environment that facilitates the enzymatic action of the polyesterase. Such conditions may be readily determined through routine testing by the skilled enzymologist. In the context of fibers, yarns or fabrics used in the production of a textile, in a preferred embodiment the textile properties are modified. In the context of a resin or a film, the surface characteristics of the polyester film or resin are modified to, e.g., modify the hydrophilicity of the surface of its ability to adhere charged coatings or other substances to the surface.

"Textile finish" means sizing agents, lubricants, defoaming agents, anti-static agents and other compositions added to polyester fibers, yams or fabrics during the manufacture of consumer or industrial products.

Treating according to the instant invention may comprise preparing an aqueous solution (or organic solvent or mixtures of organic compounds) that contains an effective amount of a polyesterase or a combination of polyesterases together with other optional ingredients including, for example, a buffer or a surfactant. An effective amount of a polyesterase enzyme composition is a concentration of polyesterase enzyme sufficient for its intended purpose. Thus, for example, an "effective amount" of polyesterase in a composition intended to produce depilling over a series of washes according to the present invention is that amount which will provide the desired effect, e.g., to improve the textile properties of the polyester containing textile article in comparison with a similar method not using polyesterase or to improve the surface properties of a film or resin. The amount of polyesterase employed is also dependent on the equipment employed, the process parameters employed, e.g., the temperature of the polyesterase treatment solution, the exposure time to the polyesterase solution, and the polyesterase activity (e.g., a particular solution will require a lower concentration of polyesterase where a more active polyesterase composition is used as compared to a less active polyesterase composition). The exact concentration of polyesterase in the treatment solution can be readily determined by the skilled artisan based on the above factors as well as the desired result. However, it has been observed by the inventors herein that the benefit disclosed herein requires a relatively rigorous polyesterase treatment. Thus, the benefits described herein are not likely to be shown with modest concentrations of polyesterase and relatively short (less than one hour) treatment times with presently characterized enzymes. Nonetheless, it is possible and preferable that an engineered polyesterase or a polyesterase with exceptionally high activity on polyester under given conditions could be obtained which would require less than 1 hour of treatment to reach the desired benefit levels and thus fall within the scope of the present invention. Similarly, employing large amounts of polyesterase for relatively short periods of time may also result in achievement of the benefits described herein.

In one treating embodiment, a buffer may be employed in the treating composition such that the concentration of buffer is sufficient to maintain the pH of the solution within the range wherein the employed polyesterase exhibits the desired activity. The pH at which the polyesterase exhibits activity depends on the nature of the polyesterase employed. The exact concentration of buffer employed will depend on several factors which the skilled artisan can readily take into account. For example, in a preferred embodiment, the buffer as well as the buffer concentration are selected so as to maintain the pH of the final polyesterase solution within the pH range required for optimal polyesterase activity. The determination of the optimal pH range of the polyesterase of the invention can be ascertained according to well known techniques. Suitable buffers at pH within the activity range of the polyesterase are also well known to those skilled in the art in the field.

In addition to polyesterase and a buffer, the treating composition may contain a surfactant, i.e., a cationic, non-ionic or anionic surfactant. Suitable surfactants include any surfactant compatible with the polyesterase being utilized and the fabric including, for example, anionic, non-ionic and ampholytic surfactants. Suitable anionic surfactants include, but are not limited to, linear or branched alkylbenzenesulfonates; alkyl or alkenyl ether sulfates having linear or branched alkyl groups or alkenyl groups; alkyl or alkenyl sulfates; olefinsulfonates; alkanesulfonates and the like. Suitable counter ions for anionic surfactants include, but are not limited to, alkali metal ions such as sodium and potassium; alkaline earth metal ions such as calcium and magnesium; ammonium ion; and alkanolamines having 1 to 3 alkanol groups of carbon number 2 or 3. Ampholytic surfactants include, e.g., quaternary ammonium salt sulfonates, and betaine-type ampholytic surfactants. Such ampholytic surfactants have both the positive and negative charged groups in the same molecule. Nonionic surfactants generally comprise polyoxyalkylene ethers, as well as higher fatty acid alkanolamides or alkylene oxide adduct thereof, and fatty acid glycerine monoesters. Mixtures of surfactants can also be employed in manners known to those skilled in the art.

In a particularly preferred embodiment of the invention, it is desirable to add glycerol, ethylene glycol or polypropylene glycol to the treating composition. Applicants have discovered that the addition of glycerol, ethylene glycol, or polypropylene glycol contributes to enhanced activity of the polyesterase on polyester. Applicants have determined that defoaming agents and/or lubricants such as Mazu® have a desirable effect on the activity of the polyesterase.

In some embodiments, it may be desirable to adjust the parameters discussed above for the purpose of controlling the enzymatic degradation. For example, the pH can be adjusted at certain time points to extinguish the activity of the polyesterase and prevent undesirable excessive degradation. Alternatively, other art recognized methods of extinguishing enzyme activity may be implemented, e.g., protease treatment and/or heat treatment.

As can be seen above, the present invention is useful in the preparation of laundry detergents. For example, it may be desirable to encourage the uptake of a cationic laundry adjuvant, i.e., a fabric softener or other such compounds which improve the feel, appearance or comfort of laundered fabrics. In this case, the present invention will provide for methods to modify the polyester during the wash cycle so as to encourage the uptake of the advantageous adjuvant.

EXAMPLES

Example 1

This Example provides for two assays which identify polyesterase activity in a potential enzyme candidate. Preferably, the enzyme will show polyester hydrolysis activity in both assays.

(A) Assay for Enzymatic Hydrolysis of Long Chain Polyester Polymer Fibers Based on Ultraviolet Light Absorbance (UV Assay)

This assay monitors the release of terephthalate and its esters resulting from the enzymatic hydrolysis of polyester and measures the hydrolysis product by subjecting the sample to the UV spectrum and measuring absorbance.

Materials

Enzyme reaction buffer: 100 mM Tris, pH 8, optionally containing 0.1% Brij®-35

Procedure

1. The polyester is washed with hot water and air dried. Applicants recommend and exemplify herein the use of such easily obtained standardized polyesters as Dacron® 54 woven polyester (from Testfabrics)(used in the description below). However, it will often be preferable to use the specific polyester substrate for which modification is desired, e.g., fabric, powder, resin or film, thereby ensuring that the enzyme selected will have optimal activity on that specific substrate. In such case, it is merely necessary to substitute the desired polyester substrate for the below described Dacron.

2. ⅝-inch circular swatches are cut from the Dacron® 54.

3. The swatches are incubated in reaction buffer in seated 12-well microtiter plates with orbital shaking at 250 rpm. A typical reaction is 1 mL in volume, with 10 $\mu$g enzyme. Three samples should be run: (1) substrate+buffer, (2) enzyme+buffer, (3) enzyme+substrate+buffer.

4. The reaction is allowed to proceed for 18 hours at 40° C.

5. Terephthalate and its esters have characteristic strong absorbance peaks around 240–244 nm ($\epsilon_M$~10,000). Therefore, if these species are released to the liquid phase of the reaction by enzymatic hydrolysis, the absorbance of liquid phase of the reaction will be increased at these wavelengths.

6. To determine if hydrolysis has occurred, one determines the absorbance of the liquid phase of the enzyme+substrate+buffer reaction at around 240–250 nm. The appropriate blanks (substrate+buffer, and enzyme+buffer) must be subtracted. These measurements can be carried out in a quartz cuvette in a spectrophotometer or a UV-transparent microtiter plate in a microplate reader capable of the required wavelengths.

7. To confirm that the absorbance readings higher than the blanks are actually due to terephthalate compounds, an absorbance spectrum of the reaction mixture should be scanned from 220–300 nm. Only a peak around 240–244 nm should be considered as actual reaction product.

8. Terephthalic acid and diethyl terephthalate are commercially available. Their absorbance spectra should serve as standards.

(B) Assay for Enzymatic Hydrolysis of Long Chain Polyester Polymer Fibers Based on Binding of Methylene Blue (MB Assay)

This assay utilizes the binding of methylene blue, a cationic dye, to the free carboxylate groups generated by hydrolysis of polyester.

Materials

Enzyme reaction buffer: 100 mM Tris, pH 8, containing 0.1% Triton® X-100

Wash buffer: 100 mM MES, pH 6.0

Dye solution: 0.1 mg/mL methylene blue in 1 mM MES, pH 6.0

Dye elution buffer: 0.5 M NaCl in 10 mM MES, pH 6.0

Dacron 54 woven polyester from Testfabrics.

Procedure

1. The polyester is washed with hot water and air dried. Applicants recommend the use of such easily obtained standardized polyesters as Dacron® 54 woven polyester (from Testfabrics) (used in the description below). However, it will often be preferable to use the specific polyester substrate for which modification is desired, e.g., fabric, powder, resin or film, thereby ensuring that the enzyme selected will have optimal activity on that specific substrate.

2. ⅝-in. circular swatches are cut from the Dacron®.

3. The swatches are incubated in reaction buffer in sealed 12-well microtiter plates with orbital shaking at 250 rpm. A typical reaction is 1 mL in volume, with 10 $\mu$g enzyme. Blanks (samples with no enzyme) should be run as well.

4. The reaction is allowed to proceed for 18 hours at 40° C.

5. The reaction solution is removed by suction, and the swatches are subsequently washed with: (1) 1 ml incubation buffer, to deplete residual enzyme; (2) 1 ml water, to deplete the incubation buffer; (3) 1 ml 100 mM MES buffer, to equilibrate the swatches to pH 6; and (4) 1 ml water again, deplete the MES buffer.

6. 1 mL of dye solution is added to each well, and the plate is shaken at 250 rpm for 20 min at 40° C. In this case, methylene blue is used. However, other cationic dyes or reporter reagents can be used as well. Hydrolysis by 100 mM NaOH can be used as a positive control.

7. The excess dye (methylene blue) is removed by suction, and the wells are washed 3 times with 1 ml water.

8. 1 mL dye elution buffer is added to each well, and the plate is shaken at 250 rpm for 30 min at 40° C.

9. 300 μL of the dye eluate is transferred from each well to a 96-well plate, and the absorbance peak at 650 nm is determined.

In either of the above assays described in Examples 1(a) and 1(b), the absorbance reading should show significant hydrolytic product which is not attributable to experimental error or non-hydrolytic effects. One of skill in the art is well aware of these effects and how to guard against them in interpreting results.

(C) Assay for Enzymatic Hydrolysis of Diethyl Terephthalate (DET)

This spectrophotometric assay monitors the change in the UV spectrum of DET which accompanies its hydrolysis.

DET has a characteristic absorbance peak around 244 nm $\epsilon_M$~10,000). The ester hydrolysis products have a lower absorbance, and the peak is shifted to 240 nm. Consequently, the hydrolysis of DET can be monitored by measuring the decrease in absorbance at 250 nm.

Reagents

Enzyme reaction buffer: 10 mM Tris, pH 8

DET stock solution: 100 mM in DMSO

Procedure

1. Dilute DET 1000-fold into reaction buffer to yield a 100 μM solution. Place in a cuvette or UV transparent microtiter plate.

2. Set the spectrophotometer wavelength at 250 nm.

3. Add enzyme, and monitor the change in absorbance. In a separate sample of the same volume of buffer without enzyme, determine the absorbance change resulting from background hydrolysis.

4. Reaction rate is calculated from the linear portion of the reaction progress curve and reported as −mAU/min and the reaction rate of the buffer blank is subtracted.

(D) Comparison of Results of PET and DET Assays

Enzymes having esterase and/or lipase activity were obtained from numerous sources and tested according to the assays described in Examples 1(a), 1(b) and 1(c). The relative results are tabulated in Table I with the hydrolysis product absorbance of *P. mendocina* cutinase being calculated as 1.0 under the conditions used.

TABLE I

| Origin | Enzyme Class | DET | PET (UV) | PET (MB) |
|---|---|---|---|---|
| Blank/Control | | <0.3 | <0.1 | <0.4 |
| *Pseudomonas mendocina* | Cutinase | 1.0 | 1.0 | 1.0 |
| *Pseudomonas* sp | Lipase | 1.2 | 0.2 | <0.4 |
| *Pseudomonas fluorescens* | Lipase | <0.3 | 0.1 | <0.4 |
| *Aspergillus niger* | Esterase | 0.8 | <0.1 | <0.4 |
| *Candida antarctica* | Lipase A | <0.3 | <0.1 | <0.4 |
| *Candida antarctica* | Lipase B | 2.3 | <0.1 | <0.4 |
| *Candida lipolytica* | Lipase | 0.1 | <0.1 | <0.4 |
| *Candida rugosa* | Lipase | 0.8 | <0.1 | 0.5 |
| *Candida rugosa* | Lipase, purif. | 2.2 | <0.1 | <0.4 |
| *Humicola lanuginosa* | Lipase | 0.3 | <0.1 | <0.4 |
| *Rhizopus delmar* | Lipase | 0.7 | <0.1 | <0.4 |
| *Rhizopus javanicus* | Lipase | 0.7 | <0.1 | <0.4 |
| *Rhizopus niveus* | Lipase | 0.8 | <0.1 | <0.4 |

TABLE I-continued

| Origin | Enzyme Class | DET | PET (UV) | PET (MB) |
|---|---|---|---|---|
| *Mucor meihei* | Lipase | <0.3 | <0.1 | <0.4 |
| Wheat Germ | Lipase | 0.6 | <0.1 | <0.4 |
| Lipolase ™[1] | Lipase | 1.2 | <0.1 | <0.4 |
| Lipomax ™[2] | Lipase | 2.7 | <0.1 | 0.7 |
| Pig Pancreas | Lipase | 1.0 | <0.1 | <0.4 |
| Pig Liver[3] | Esterase I | 3.1 | <0.1 | <0.4 |
| Pig Liver | Esterase II | 2.0 | <0.1 | <0.4 |
| E001[4] | Esterase | 2.3 | <0.1 | <0.4 |
| E002 | Esterase | 3.3 | <0.1 | <0.4 |
| E003 | Esterase | 5.0 | <0.1 | <0.4 |
| E004 | Esterase | 1.2 | <0.1 | <0.4 |
| E005 | Esterase | 1.3 | <0.1 | <0.4 |
| E006 | Esterase | 2.7 | <0.1 | <0.4 |
| E007 | Esterase | 2.4 | <0.1 | <0.4 |
| E008 | Esterase | 2.0 | <0.1 | <0.4 |
| E009 | Esterase | 1.5 | <0.1 | <0.4 |
| E010 | Esterase | 2.6 | <0.1 | <0.4 |
| E011 | Esterase | 4.0 | 0.1 | <0.4 |
| E012 | Esterase | 1.1 | <0.1 | <0.4 |
| E013 | Esterase | 2.4 | <0.1 | <0.4 |
| E014 | Esterase | 5.2 | <0.1 | <0.4 |
| E015 | Esterase | 3.6 | <0.1 | <0.4 |
| E016 | Esterase | 2.0 | <0.1 | <0.4 |
| E017b | Esterase | 3.7 | <0.1 | <0.4 |
| E018b | Esterase | 0.6 | <0.1 | <0.4 |
| E019 | Esterase | 0.9 | <0.1 | <0.4 |
| E020 | Esterase | 2.0 | <0.1 | <0.4 |
| ESL-001-01[5] | Esterase | 0.7 | <0.1 | <0.4 |
| ESL 001-02 | Esterase | 4.6 | <0.1 | <0.4 |
| ESL-001-03 | Esterase | 0.6 | <0.1 | <0.4 |
| ESL 001-04 | Esterase | 1.3 | <0.1 | <0.4 |
| ESL 001-05 | Esterase | 0.9 | <0.1 | <0.4 |
| ESL 001-06 | Esterase | 0.4 | <0.1 | <0.4 |
| ESL 001-07 | Esterase | 0.9 | <0.1 | <0.4 |
| Chiro-CLEC-CR[6] | EC 3.1.1.3 | 0.5 | <0.1 | <0.4 |
| Chiro-CLEC-BL | EC 3.4.21.14 | <0.3 | <0.1 | <0.4 |
| Chiro-CLEC-PC | EC 3.1.1.3 | 0.8 | 0.1 | <0.4 |
| Chiro-CLEC-EC | EC 3.5.1.11 | 0.7 | <0.1 | <0.4 |

[1](commercial product obtained from Novo Nordisk)

[2](commercial product obtained from Genencor International, Inc.)

[3](Pig Liver Esterase I and II obtained from Boehringer Mannheim Chira-Zyme ™ Lipases & Esterases Screening Set (Germany))

[4](All E series esterases listed were obtained from the ThermoCat ™ R&D product line from Thermogen (Chicago, IL))

[5](All "ESL" series esterases were obtained from Diversa Esterase/Lipase CloneZyme ™ Library)

As can be seen from the above, nearly all of the enzymes tested have activity in the DET assay (di-esterase activity). However, only one of the tested enzymes has significant activity in both of the PET assays. From this evidence, it is apparent that, while there is cross over in terms of enzymes which have activity in the DET assay and also have PET hydrolytic activity, there are a great number of enzymes which do have DET hydrolytic activity but do not have polyesterase activity. As shown in Examples 2 and 3, the enzyme with PET activity provides significant enzymatic conversion of the polyester fibers. From this data, Applicants determined that the identity of an enzyme having polyesterase activity cannot be predicted from whether that enzyme has mono- or di-esterase activity.

[6] (All ChiroCLEC™ enzymes obtained from Altus Corp ChiroScreen™ Enzyme Set (Cambridge, Mass.))

Example 2

Enzymatic Surface Modification of Polyester Fibers with Polyesterase to Modify the Functional Surface Properties of the Polyester Equipment: Launder-Ometer Treatment pH: pH 8.6 (50 mM Tris Buffer)

Treatment temperature: 40° C.

Treatment time: 24 hours

Enzyme: Cutinase from *Pseudomonas mendocina* @ 40 ppm

Control: Inactivated cutinase (*Pseudomonas mendocina*) @ 40 ppm

Substrates: 100% Polyester-

-Dacron® 54 (style number 777 from TestFabrics)

-Dacron®64 (style number 763 from TestFabrics)

To ensure that all observed effects were due solely to the modification of the polyester surface, and not from adhered protein effects, the swatches were treated with protease. After the polyesterase treatments, ⅝ inch disks were cut from the treated swatches. Then the disks were incubated with 5 ppm subtilisin and 0.1% non-ionic surfactant (Triton X-100) to remove proteins bound onto polyester. The levels of bound proteins were examined using coomassie blue staining to ensure that minimal protein remained bound to the fabric.

After enzyme treatment followed by protease/surfactant treatments, the disks were dyed in 12 well microtiter plate under the following conditions:

Liquor ratio: 40 to 1

Dye concentration: 0.4% owf

Temperature: 40° C.

pH: 6 ( 1 mM MES buffer at pH 6.0)

Time: 20 minutes

Agitation of shaker: 200 rpm

The disks were rinsed three times with DI water after dyeing, air dried, and then measured for CIE L*a*b* values using a reflectometer. The total color difference was calculated using the following formula:

$$\text{Delta } E = \text{Square Root } (\Delta L^{*2} + \Delta a^{*2} + \Delta b^{*2}$$

ΔL=Difference in CIE L*values before and after dyeing

Δa=Difference in CIE a*values before and after dyeing

Δb=Difference in CIE b*values before and after dyeing (These terms are defined in, for example, Duff & Sinclair, Giles's Laboratory Course in Dyeing, 4th Edition, Society of Dyers and Colourists).

Table 1. Total Color Difference after Dyeing with Different Basic Dyes

TABLE 1

Total Color Difference after Dyeing with Different Basic Dyes

| Basic Dyes | | Total Color Difference (ΔE) | | | |
|---|---|---|---|---|---|
| | | Dacron 54 | | Dacron 64 | |
| | Dye classes | Control | Cutinase | Control | Cutinase |
| Methylene Blue | | 8.37 | 14.66 | 20.28 | 25.10 |
| C.I. Basic Yellow 28 | (Monazo) | 10.72 | 20.05 | 26.32 | 32.09 |

TABLE 1-continued

Total Color Difference after Dyeing with Different Basic Dyes

| Basic Dyes | | Total Color Difference (ΔE) | | | |
|---|---|---|---|---|---|
| | | Dacron 54 | | Dacron 64 | |
| | Dye classes | Control | Cutinase | Control | Cutinase |
| C.I. Basic Yellow 29 | (Methine) | 9.99 | 20.35 | 28.17 | 34.92 |
| C.I. Basic Orange 42 | (Azo-methine-azo) | 20.75 | 27.15 | 33.04 | 39.81 |
| C.I. Basic Orange 48 | (Azo) | 10.92 | 21.41 | 20.30 | 26.15 |
| C.I. Basic Blue 45 | (Anthra-quinone) | 10.18 | 10.27 | 17.06 | 21.21 |
| C.I. Basic Blue 77 | (Triaryl-methane) | 20.53 | 27.59 | 28.81 | 40.89 |

Figure 2:
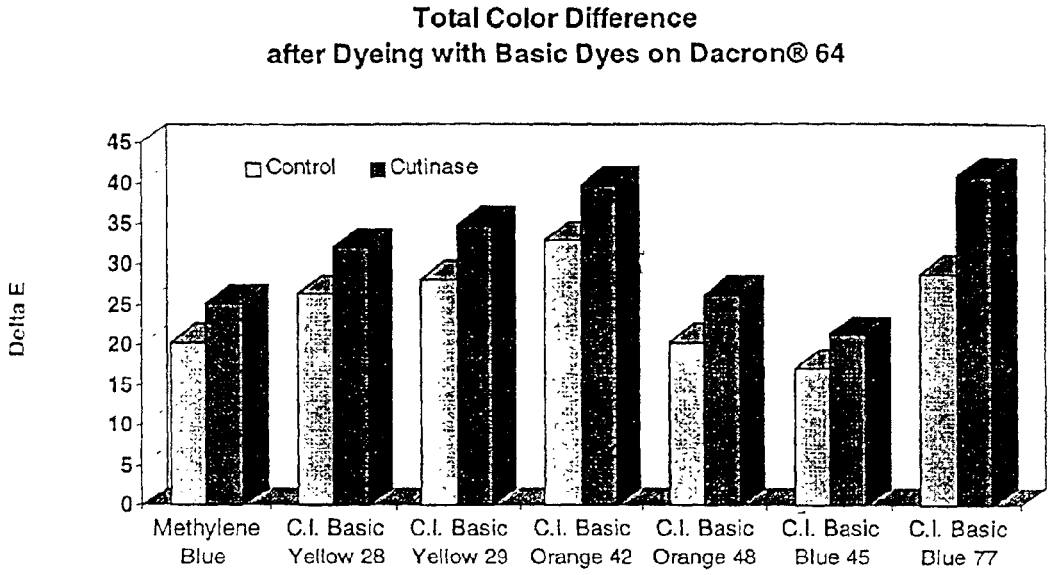
FIG. 2 illustrates the effect of polyesterase treatments on the dyeability of Dacron 64.

The results are compiled graphically in FIGS. 1 and 2. As can be seen, polyesterase significantly effects the ability of the polyester fabrics to take up and adhere a range of cationic dyes.

Example 3

Enzyme Catalyzed Polyester Treatment (A) Enzymatic Polyester De-Pilling To demonstrate de-pilling of polyester by a polyesterase, the following experiments were done using 24 hour pre-pilled Dacron® 54*swatches at 40° C. Each Launder-Ometer cycle was taken for 24 hours, and three (5"×7") swatches were added per experiments.

*Dacron® 54 is 100% disperse dyeable polyester manufacture by Dupont.

Exp. 1) 50 mM Tris Buffer (pH 8.6)+0.01% sodium azide

Exp. 2) 50 mM Tris Buffer (pH 8.6)+0.01% sodium azide+polyesterase (cutinase from *P. mendocina*)

Exp. 3) 20 mM NaOH

After each cycle, the swatches were rinsed with DI water, and then transferred into autoclaved Launder-Ometer canisters with fresh solution.

NaOH treated swatches (Exp. 1) exhibited clear de-pilling effect after 5th cycle, and the experiment was stopped. After each cycle, absorbance of treated liquor at 250 nM were measured to quantify PET hydrolysis.

Clear differences in de-pilling were observed between buffer control (Exp. 1) vs. polyesterase treated (Exp. 2) swatches. The experiments were stopped after 14th cycle.

Figure 3:
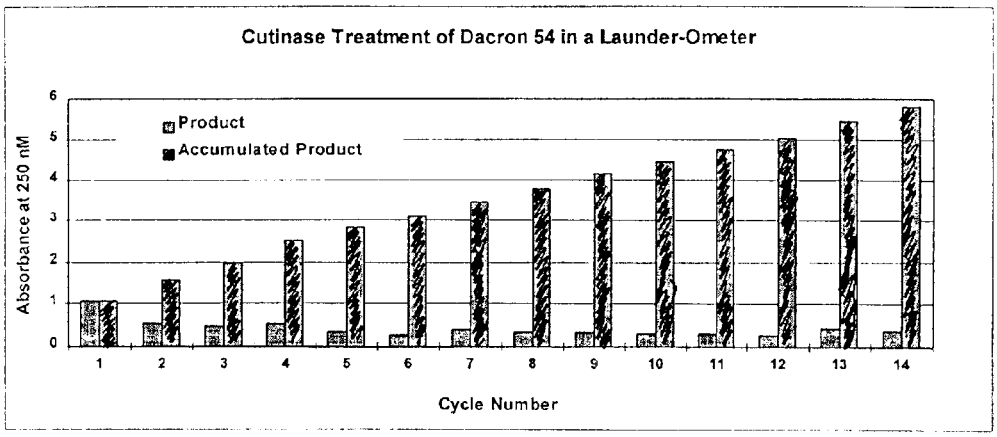
FIG. 3 illustrates comparative quantitative hydrolysis product from polyesterase enzyme treatment of Dacron 54.

These results show that the polyesterase treatment produced a marked improvement in depilling as compared to the treatment with control. In addition, as shown in FIG. 3, the improvement in depilling corresponded to the accumulation of PET hydrolysis products in the liquor, confirming that the improvement in pilling characteristics was the result of the hydrolytic action of the enzyme on the polyester.

(B) Enzyme Mediated Polyester Fabric Weight Loss

Figure 4:
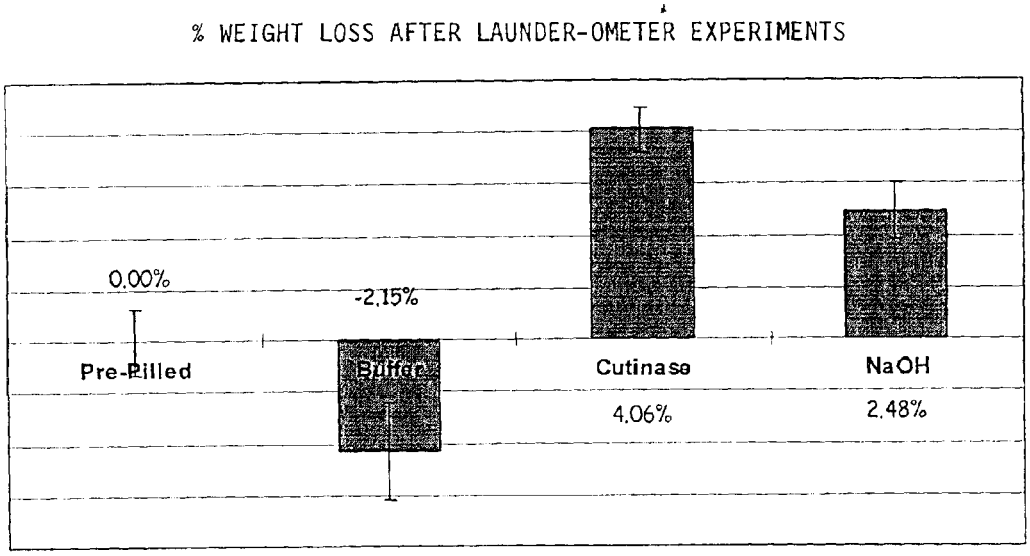
FIG. 4 illustrates weight loss of a polyester after treatment with a polyesterase enzyme.
Figure 5:
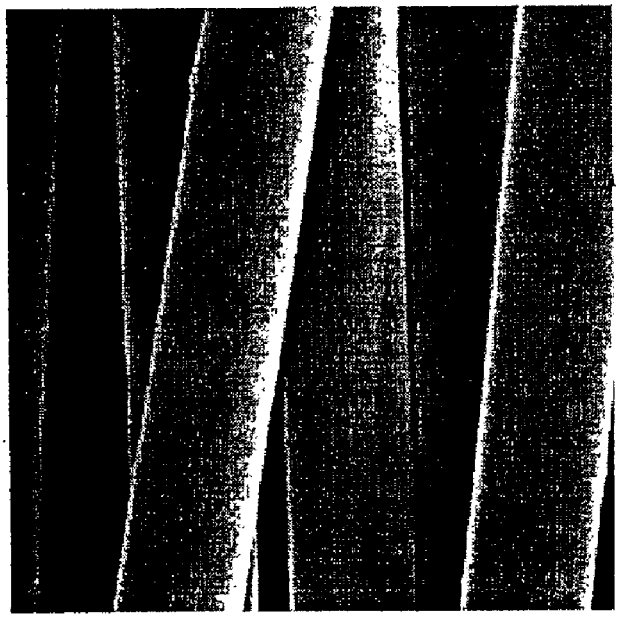
FIG. 5 illustrates a scanning electron micrograph of polyester fiber incubated w/100 mM Tris Buffer (pH 8.6/40° C.). 1000×.
Figure 6:
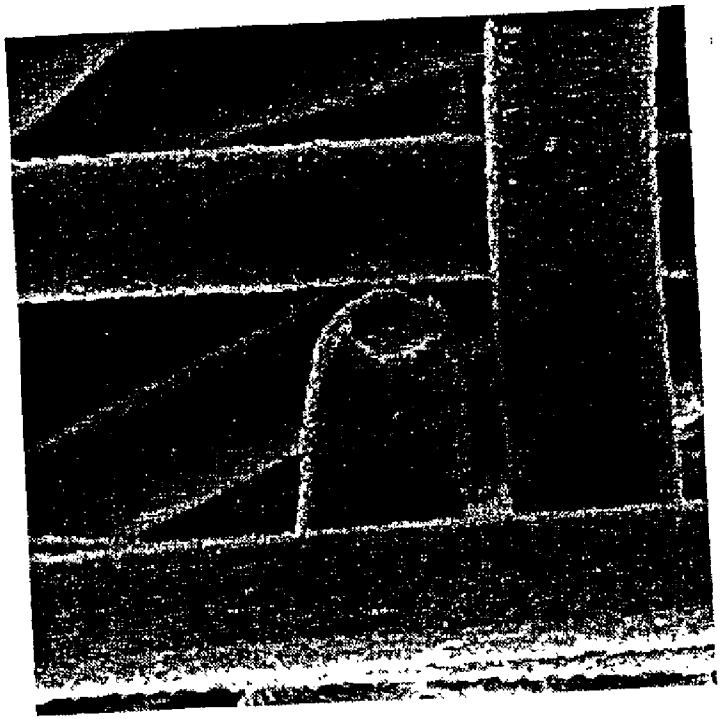
FIG. 6 illustrates a scanning electron micrograph of polyester fiber incubated with Tris Buffer+Cutinase (pH 8.6/40° C.). 1000×.
Figure 7:
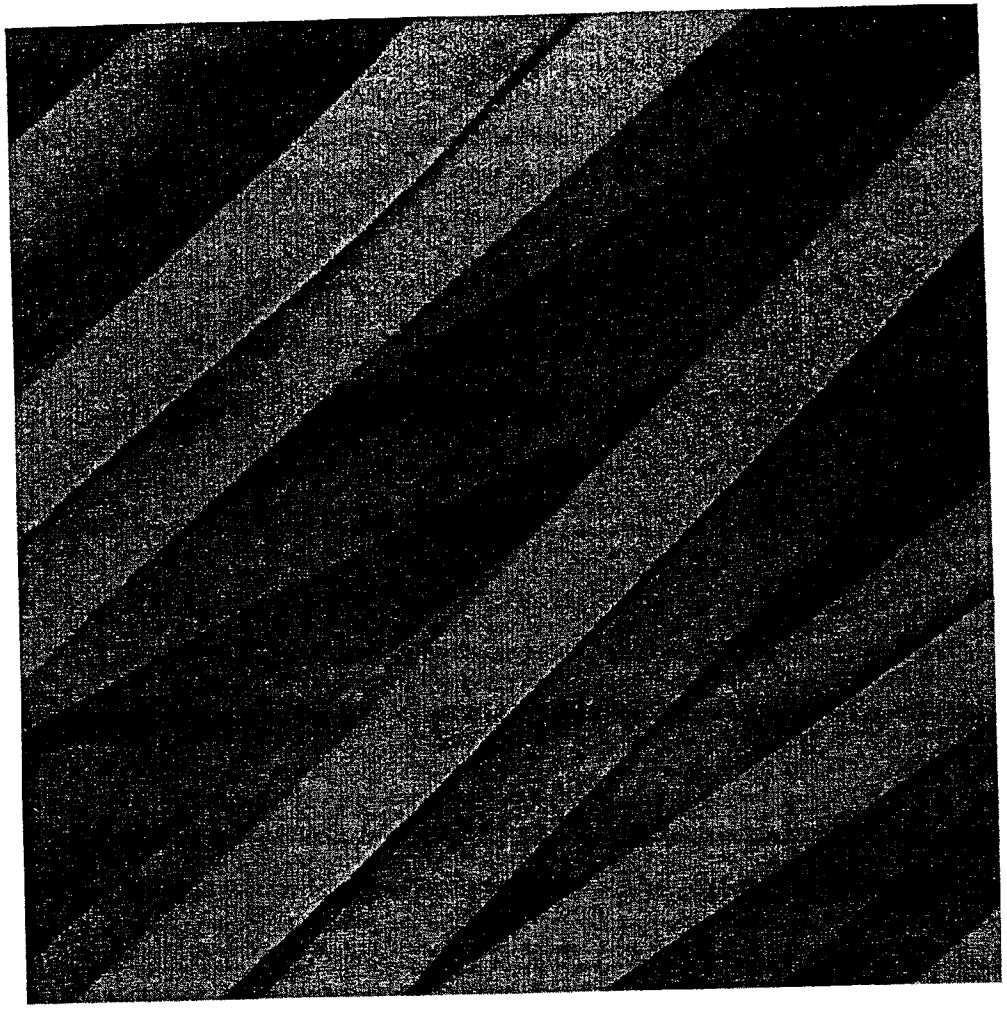
FIG. 7 illustrates a scanning electron micrograph of polyester fiber incubated with buffer and glycerol (50/50 w/w). 500×.
Figure 8:
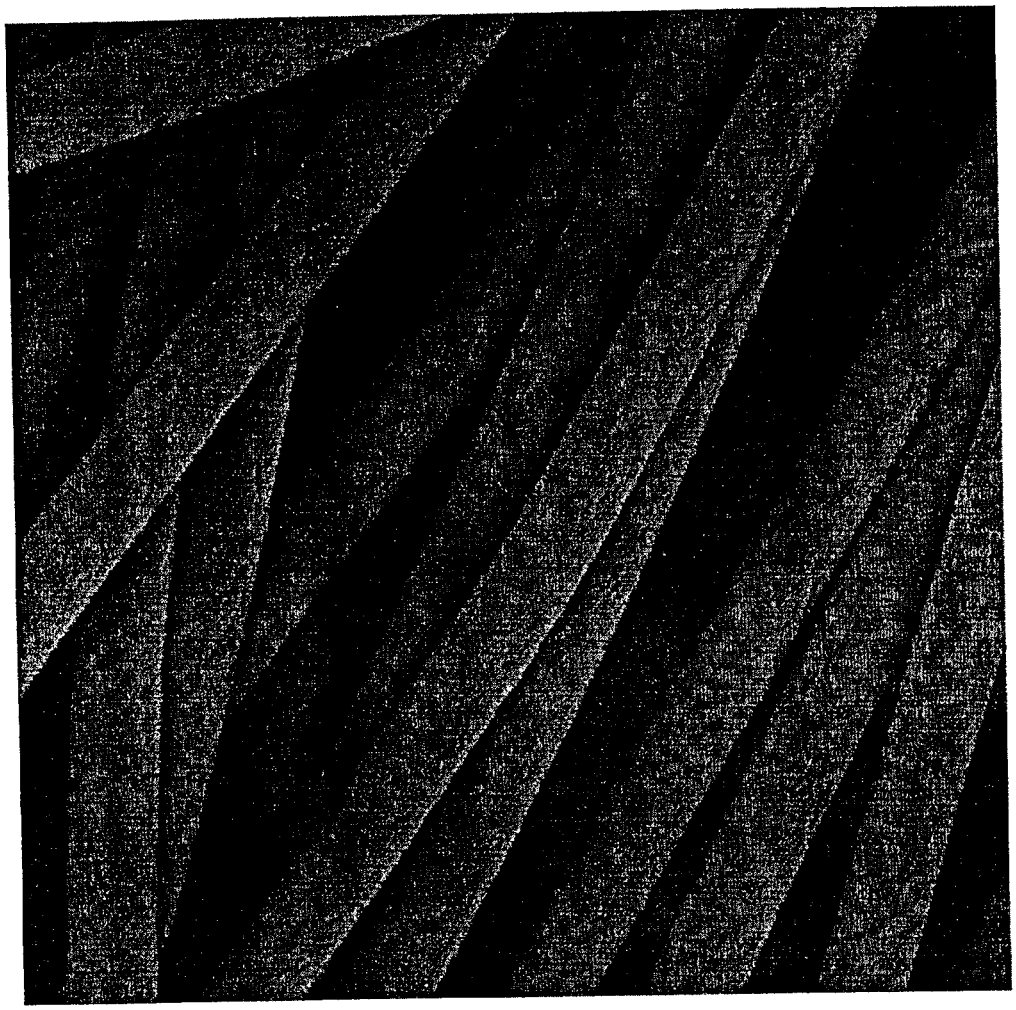
FIG. 8 illustrates a scanning electron micrograph of polyester fiber treated w/buffer and glycerol and cutinase. 500×.

After the Launder-Ometer experiments described above, treated swatches (three per experiment) were weighed individually and the average weight loss was calculated. The results are shown in FIG. 4.

Both polyesterase treated and NaOH treated swatches showed significant weight loss compared to the buffer control and pre-pilled swatches ($p<0.05$).

(C) Electron Microscopy Showing Polyesterase Caused Surface Modiflcation

PET fibers incubated with 1) buffer and 2) buffer+*P. mendocina* cutinase for a month at 40° C. were photographed using scanning electron microscopy. The results are provided in FIGS. 5–8.

(D) Hydrolysis of PTT with Cutinase

Equipment: Launder-Ometer

Treatment pH: pH 8.6 (50 mM Tris Buffer)

Treatment temperature: 40° C.

Treatment time: 24 hours

Enzyme: Cutinase (*Pseudomonas mendocina*) @ 40 ppm

Control: Inactivated cutinase (*Pseudomonas mendocina*) @ 40 ppm

Substrates: scoured 100% Corterra® brand PTT polyester

Figure 9:
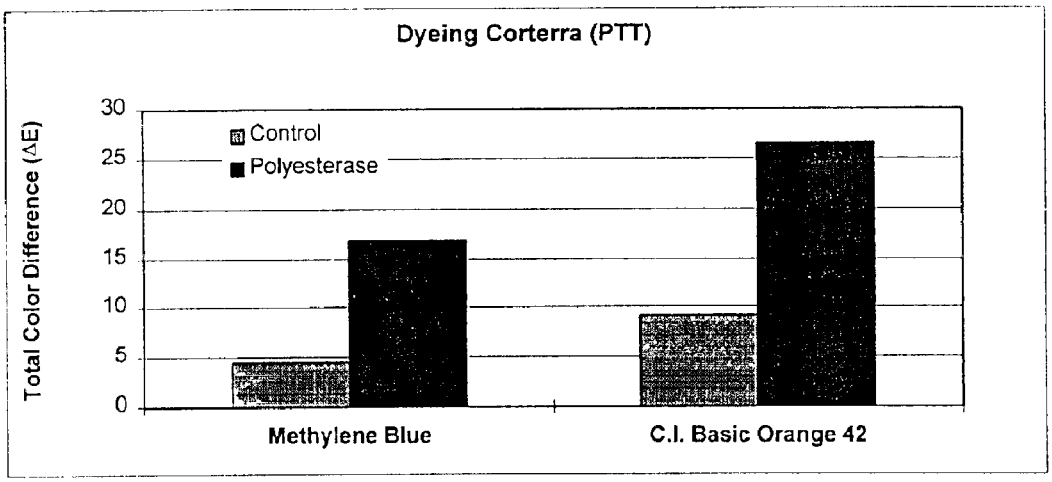
FIG. 9 illustrates the effect of polyesterase treatments on the dyeability of Corterra™ fabric.

After the cutinase treatments, ⅝ inch disks were cut from the treated swatches. The disks were incubated with 5 ppm subtilisin and 0.1% non-ionic surfactant (Triton X-100) to remove proteins bound onto polyester. The increase in dyeability is shown in FIG. 9. From this data, it is apparent that the polyesterase modified the surface properties of the PTT based fabric.

All patent and literature references cited in the present specification are hereby incorporated by reference in their entirety.

What is claimed is:

1. A method for modifying the surface of an aromatic polyester resin, film, fiber, yarn or fabric during manufacture comprising treating said aromatic polyester resin, film, fiber, yarn or fabric during manufacture with a polyesterase wherein said polyesterase is derived from *Pseudomonas* spp. the treatment occurring prior to the application of a finish and without use of a surfactant for a time and under conditions sufficient to modify the properties of said aromatic polyester, wherein said modified properties of said treated aromatic polyester are selected from the group consisting of pilling, pilling prevention, weight, feel, appearance and luster.

2. A method for modifying the textile characteristics of an aromatic polyester textile article prior to the application of a finish to the aromatic polyester textile article, comprising the steps of:

(a) obtaining a polyesterase, wherein said polyesterase is derived from *Pseudomonas* spp.;

(b) contacting said polyesterase an aromatic polyester textile during manufacture and without the use of a surfactant under conditions and for a time suitable for said polyesterase to produce a modified polyester textile; and (c) incorporating said modified aromatic polyester into a textile article.

3. The method according to claim 1, wherein said aromatic polyester fiber, yarn or fabric is subsequently incorporated into a textile.

4. The method according to claim 1, wherein said treatment occurs in the presence of polypropylene glycol or glycerol.

5. A method for enzymatically modifying the characteristics of an unsoiled aromatic polyester textile comprising; treating said aromatic polyester textile during manufacture prior to the application of a finish and without the use of a surfactant with a polyesterase enzyme derived from *Pseudomonas* spp., the treatment for an time and under conditions to modify the textile properties of said aromatic polyester textile, wherein said modified textile properties of the treated aromatic polyester comprise the pilling, pilling prevention, weight, feel, appearance or luster.

6. The method according to claim 5, wherein said polyesterase is derived from *Pseudomonas mendocina*.

7. A method for modifying the surface of an aromatic polyester resin, film, fiber, yarn or fabric during manufacture comprising contacting said aromatic polyester resin film, fiber, yarn or fabric during manufacture, prior to the application of a finish and without the use of a surfactant, with a polyesterase derived from *Pseudomonas* spp., the treatment for a time and under conditions to modify the properties of said polyester wherein said modified textile properties of the treated polyester comprise the pilling, piling prevention, weight, feel, appearance or luster.

8. The method according to claim 7, wherein said polyesterase is derived from *Pseudomonas mendocina*.

* * * * *